US007774965B2

(12) United States Patent
Lee

(10) Patent No.: US 7,774,965 B2
(45) Date of Patent: Aug. 17, 2010

(54) ILLUMINATED EMERGENCY SIGN

(75) Inventor: Sung-Keun Lee, Huizhou (CN)

(73) Assignee: Je Woo Corporation, Ltd., Hui Yang, Guang Dong (CN)

( * ) Notice: Subject to any disclaimer, the term of this patent is extended or adjusted under 35 U.S.C. 154(b) by 0 days.

(21) Appl. No.: 12/367,532

(22) Filed: Feb. 8, 2009

(65) Prior Publication Data

US 2010/0107462 A1 May 6, 2010

(30) Foreign Application Priority Data

Nov. 6, 2008 (CN) ..... 2008 2 0213168 U

(51) Int. Cl.

| | |
|---|---|
| ***G09F 13/04*** | (2006.01) |
| ***G09F 7/22*** | (2006.01) |
| ***G09F 15/00*** | (2006.01) |
| ***G09F 15/02*** | (2006.01) |
| ***G09F 13/18*** | (2006.01) |
| ***G09F 3/20*** | (2006.01) |

(52) U.S. Cl. ..... 40/570; 40/617; 40/606.15; 40/658; 40/546; 40/605; 40/606.14; 248/317; 248/333; 248/223.41; 248/224.7; 248/224.61; 248/900; 248/220.22; 362/812

(58) Field of Classification Search ..... 40/570, 40/658, 617, 546, 605, 606.14, 606.15; 362/812; 248/900, 220.22, 317, 333, 223.41, 224.7, 248/224.61

See application file for complete search history.

(56) References Cited

U.S. PATENT DOCUMENTS

| | | | | |
|---|---|---|---|---|
| 3,931,689 | A * | 1/1976 | Shine | 40/570 |
| 6,457,270 | B1 * | 10/2002 | Stark et al. | 40/570 |
| 7,102,880 | B2 * | 9/2006 | Minaguchi et al. | 361/679.55 |
| 2006/0225328 | A1 * | 10/2006 | Hasan | 40/570 |

* cited by examiner

*Primary Examiner*—Lesley Morris
*Assistant Examiner*—Syed A Islam
(74) *Attorney, Agent, or Firm*—Banger Shia

(57) ABSTRACT

An illuminated emergency sign comprises a main body, a rotary body, side covers, a circuit board, a LED lamp indicator, an acrylic sign panel, and a canopy. The acrylic sign panel is connected to the lower end of the rotary body. In the rotary body is disposed a LED lamp panel. The LED lamp indicator is disposed on the LED lamp panel. The rotary body is rotatably connected to the lower end of the main body. In the main body is disposed a battery. The side covers are connected to both ends of each of the main body and the rotary body. The canopy is disposed on the top of the main body. The sign panel of such an illuminated emergency sign can be rotated within 180 degrees and fixed at a proper angle under action of the friction.

6 Claims, 5 Drawing Sheets

ILLUMINATED EMERGENCY SIGN

BACKGROUND OF THE INVENTION

1. Field of the Invention

The present invention relates to an emergency sign which can used in a building to show the persons how to evacuate and escape in an emergency, and more particularly to an illuminated emergency sign.

2. Description of the Prior Art

In buildings are all provided emergency accesses for facilitating emergency evacuation when an emergency occurs, and in order to make the persons quickly find and arrive at the entrance of the emergency accesses, signs or indicator lights are normally installed on the corridor and the emergency door, for example, the illuminated emergency signs on the emergency doors in the theater. The conventional illuminated emergency signs have the disadvantages such as simplified structure, few functions, and no significant indication effect.

The present invention has arisen to mitigate and/or obviate the afore-described disadvantages.

SUMMARY OF THE INVENTION

The primary objective of the present invention is to provide an illuminated emergency sign, which can solve the disadvantages of the conventional designs to improve product applicability in different occasions.

In order to achieve the above objective, the illuminated emergency sign in accordance with the present invention comprises a main body, a rotary body, side covers, a circuit board, a LED lamp indicator, an acrylic sign panel, and a canopy. The acrylic sign panel is connected to the lower end of the rotary body. In the rotary body is disposed a LED lamp panel. The LED lamp indicator is disposed on the LED lamp panel. The rotary body is rotatably connected to the lower end of the main body. In the main body is disposed a battery. The side covers are connected to both ends of each of the main body and the rotary body. The canopy is disposed on the top of the main body.

The illuminated emergency sign in accordance with the present invention is further characterized in that:

The rotary body is in the form of a round pipe which is longitudinally defined with a lower slot, the rotary body is provided with a pair of fixing grooves on an inner surface thereof adjacent to the slot, the acrylic sign panel is fixed with fixing strips for cooperating with fixing grooves, the acrylic sign panel is fixed in the fixing grooves through the fixing strips, a light from the LED lamp indicator irradiates a surface of the acrylic sign panel through the slot.

The main body is defined with an inner arc opening, and the rotary body is connected to the inner arc opening and frictionally rotates relative to the main body.

The rotation supports are respectively disposed between the side covers and the two ends of each of the main body and the rotary body, the rotation supports are fixed on the two ends of the main body, and the rotary body is rotatably disposed between the rotation supports.

One of the side covers is provided with a test switch.

An insulation paper encloses the circuit board.

The acrylic sign panel is provided with a safety exit sign and a direction sign on a surface thereof.

The present invention has the following advantages:

1. The acrylic sign panel with the rotary body is connected to the main body through the side covers, so that the acrylic sign panel can rotate with the rotary body within 180 degrees, thus providing a significant warning and indication function and having the features such as rational structure, convenient to install and use.

2. Increasing the convenience on maintenance: when replacing the battery, the user only needs to dismount the side cover, so that the battery can be replaced easily.

3. The direction sign can be disposed as desired to satisfy different requirements.

4. Many mounting methods such as ceiling mounting, side mounting, recessed mounting, and wall mounting.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
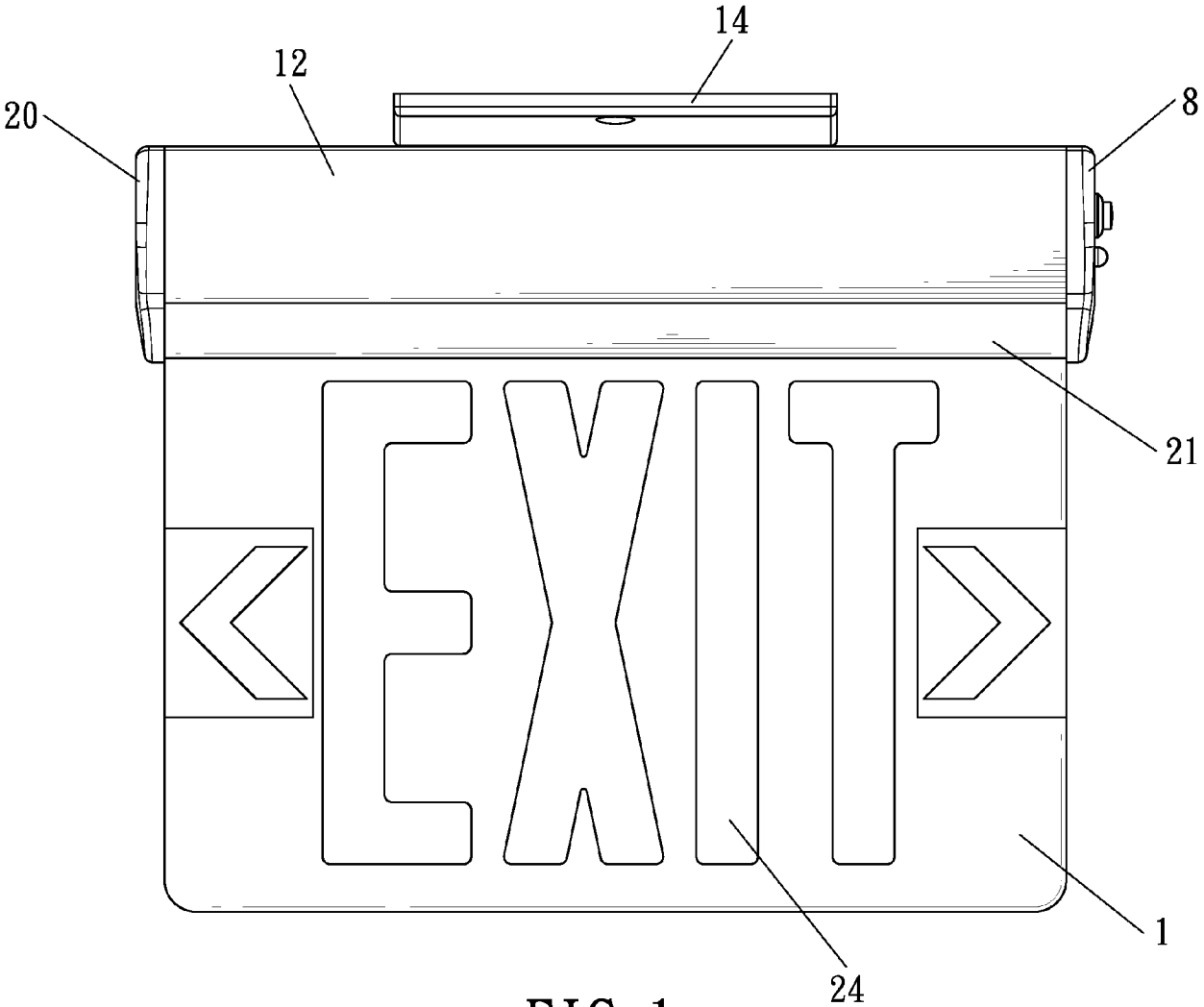
FIG. 1 is a front view of an illuminated emergency sign in accordance with the present invention.
Figure 2:
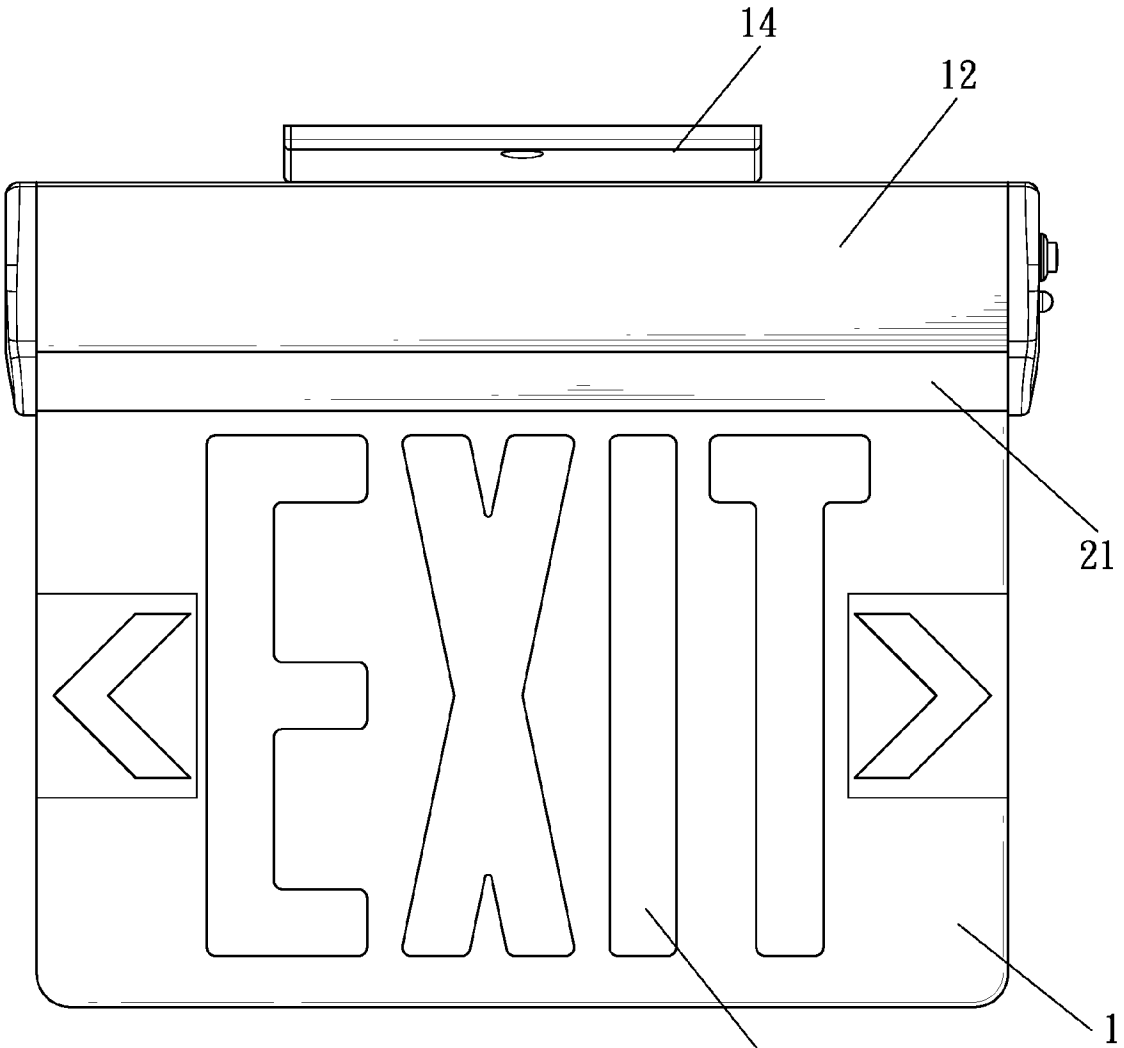
FIG. 2 is a back view of the illuminated emergency sign of FIG. 1 in accordance with the present invention.
Figure 3:
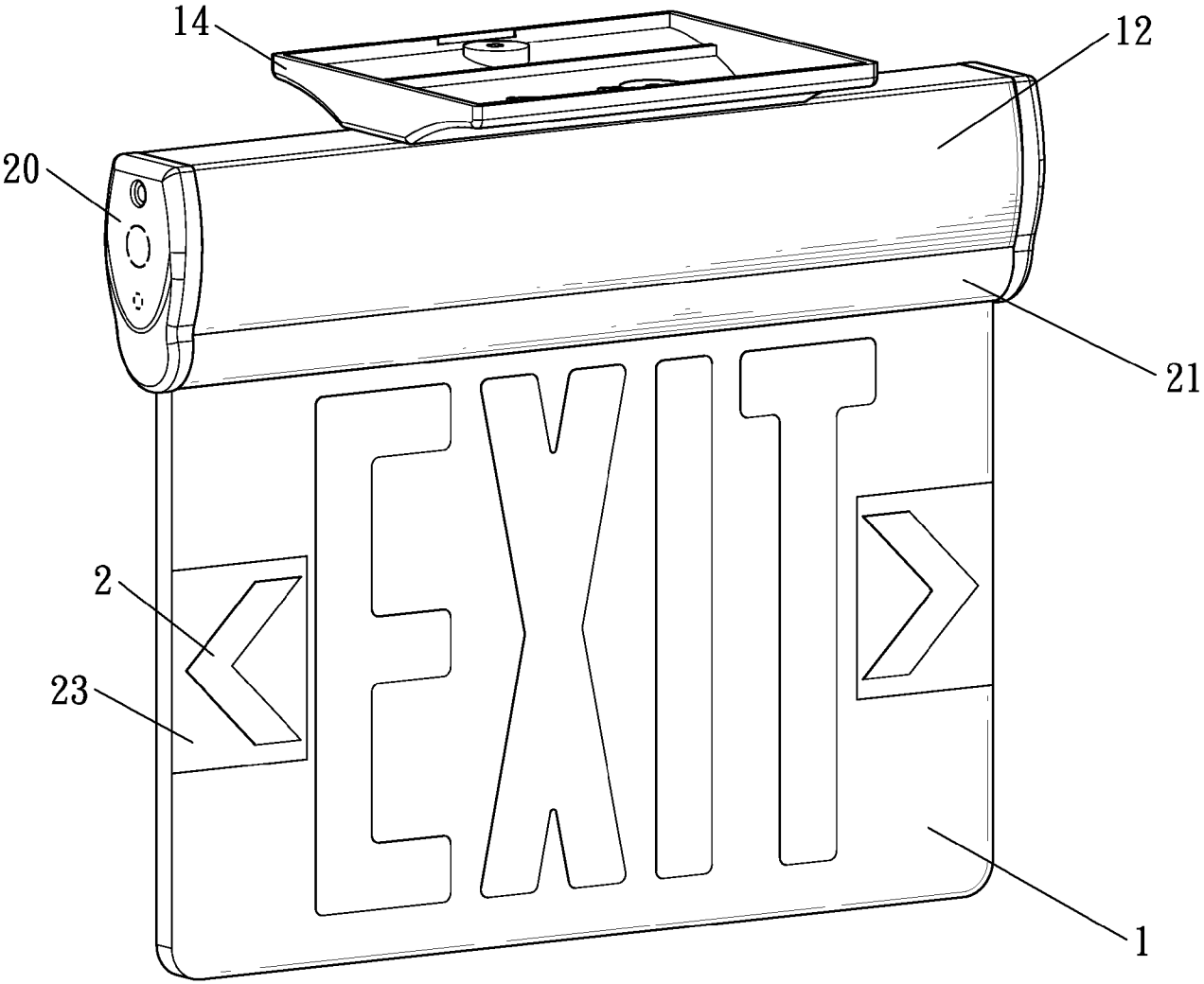
FIG. 3 is a perspective view of the illuminated emergency sign of FIG. 1 in accordance with the present invention.
Figure 4:
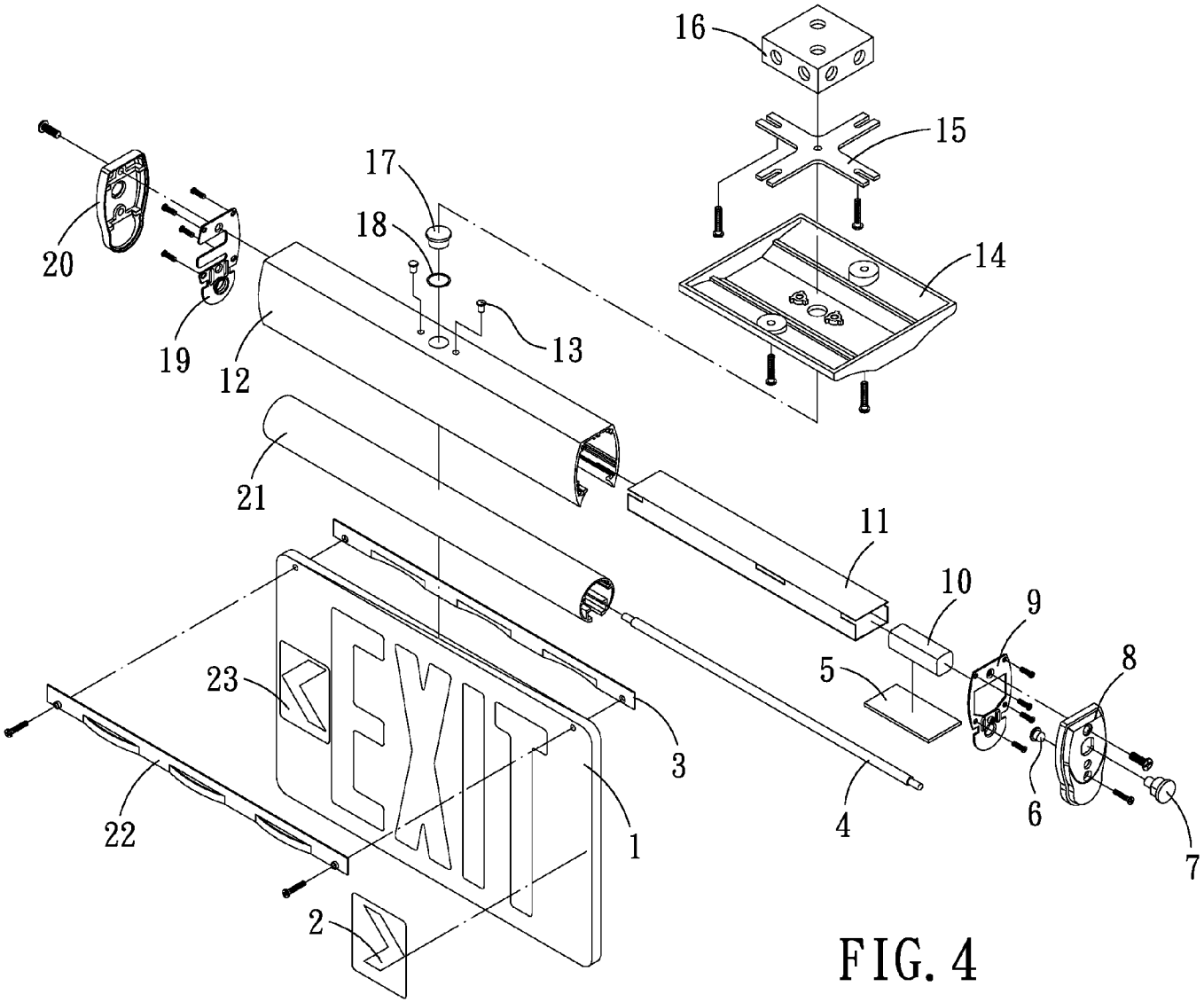
FIG. 4 is an exploded view of the illuminated emergency sign of FIG. 1 in accordance with the present invention.
Figure 6:
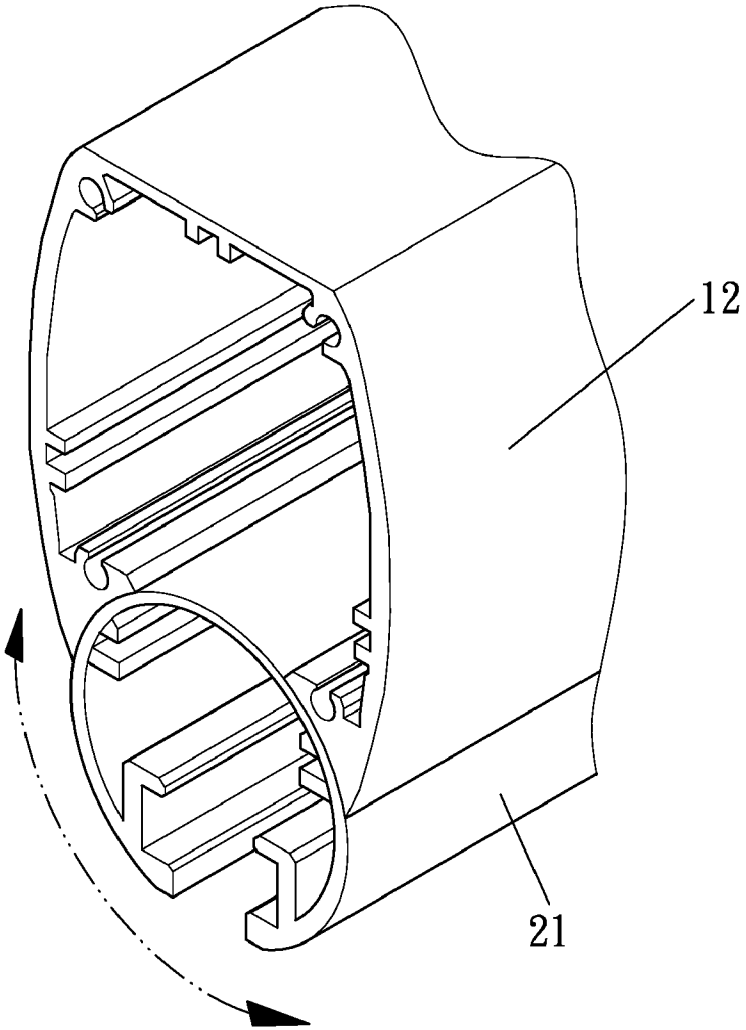
FIG. 6 is a side view of the illuminated emergency sign of FIG. 5 in accordance with the present invention.
Figure 5:
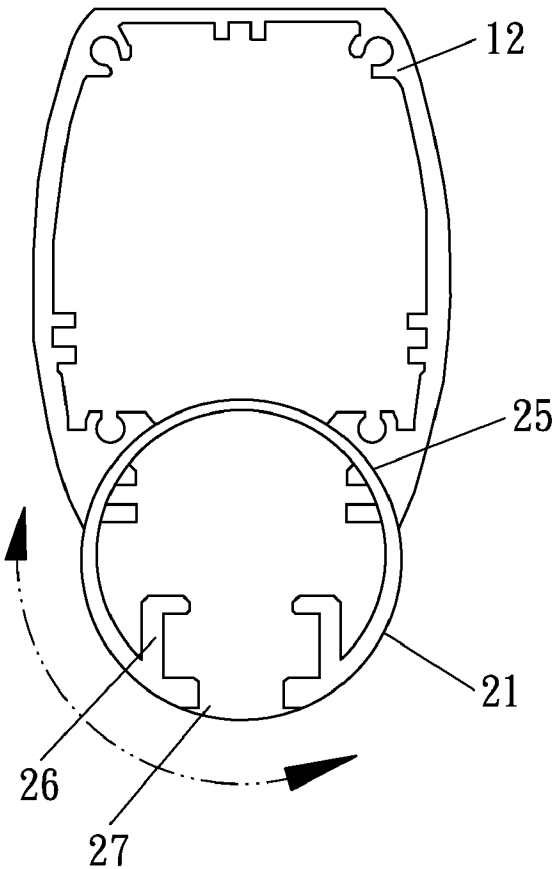
FIG. 5 is a partial view of the illuminated emergency sign of FIG. 4 in accordance with the present invention.

Referring to FIGS. 1-6, an illuminated emergency sign in accordance with the present invention essentially comprises an acrylic sign panel 1, a main body 12, a rotary body 21, a canopy 14, a circuit board 5, a LED lamp indicator 6, a left rotation support 19, a right rotation support 9, a left side cover 20, and a right side cover 8. The lower end of the main body 12 is connected to the rotary body 21, and the acrylic sign panel 1 is fixed in the rotary body 21. The left, right rotation supports 19, 9 and the left, right side covers 20, 8 are installed to both ends of the main body 12. The canopy 14 is installed on the top of the main body 12.

The main body 12 is interiorly provided with the circuit board 5, a battery 10, and an insulation paper 11 enclosing the circuit board 5. The lower end of the main body 12 is provided with an inner arc opening 25. In the inner arc opening 25 is installed the rotary body 21. The rotary body 21 is in the form of a round pipe, which is longitudinally provided with a lower slot 27. The rotary body 21 is defined with a pair of fixing grooves 26 on its inner surface adjacent to the slot 27. The LED lamp panel 4 is installed in the rotary body 21. The LED lamp indicator 6 is installed on the LED lamp panel 4. The battery 10 supplies power to the LED lamp indicator 6. The rotary body 21 is in a frictional contact with the inner arc opening 25, and the rotary body 21 frictionally rotates relative to the inner arc opening 25.

The fixing grooves 26 are disposed in the slot 27 of the rotary body 21, and the upper end of the sign panel 1 is fixed with a front and a back fixing strips 3, 22. The fixing strips 3, 22 are inserted into the fixing grooves 26 and fixed therein, and at this moment, the sign panel 1 is fixed with the rotary body 21. On the surface of the sign panel 1 is provided a safety exit sign 24 (Chinese or English) and a direction sign 2.

After the rotary body 21 and the main body 12 are installed together, the left, right rotation supports 19, 9 will be installed to both ends of each of the rotary body 21 and the main body 12 in such a manner that the rotary body 21 can rotate between the rotation supports 19, 9. The left and right side covers 20, 8 will be then installed to the left and right rotation supports 19, 9 respectively. On the right side cover 8 is installed a test switch 7. The left and right side covers link the left, right rotation supports, the rotary body and the main body together.

The working principle of the illuminated emergency sign of the present invention is described as follows.

The canopy 14 is used to install the emergency sign of the present invention on the desired position (roof, wall, door, etc), when the LED lamp indicator is turned on, the light from the LED lamp indicator will irradiate the surface of the sign panel through the slot of the rotary body. In order to enable the sign panel to be seen more clearly, the sign panel can be rotated within 180 degrees and fixed at the proper angle under the action of friction.

While we have shown and described various embodiments in accordance with the present invention, it is clear to those skilled in the art that further embodiments may be made without departing from the scope of the present invention.

What is claimed is:

1. An illuminated emergency sign, characterized in that the illuminated emergency sign comprises a main body, a rotary body, side covers, a circuit board, a LED lamp indicator, an acrylic sign panel, and a canopy, wherein the acrylic sign panel is connected to a lower end of the rotary body, the rotary body is in the form of a round pipe which is longitudinally defined with a lower slot, the rotary body is provided with a pair of fixing grooves on an inner surface thereof adjacent to the slot, the acrylic sign panel is fixed with fixing strips for cooperating with the fixing grooves, the acrylic sign panel is fixed in the fixing grooves through the fixing strips, the rotary body is interiorly provided with a LED lamp panel, the LED lamp indicator is disposed on the LED lamp panel, a light from the LED lamp indicator irradiates a surface of the acrylic sign panel through the slot, the rotary body is rotatably connected to a lower end of the main body, the main body is interiorly provided with a battery, the side covers are connected to both ends of each of the main body and the rotary body, and the canopy is disposed on a top of the main body.

2. The illuminated emergency sign as claimed in claim 1, characterized in that the main body is defined with an inner arc opening, the rotary body is connected to the inner arc opening and frictionally rotates relative to the main body.

3. The illuminated emergency sign as claimed in claim 1 further comprising rotation supports, characterized in that the rotation supports are respectively disposed between the side covers and the two ends of each of the main body and the rotary body, the rotation supports are fixed on the two ends of the main body, and the rotary body is rotatably disposed between the rotation supports.

4. The illuminated emergency sign as claimed in claim 1, characterized in that one of the side covers is provided with a test switch.

5. The illuminated emergency sign as claimed in claim 1, characterized in that an insulation paper encloses the circuit board.

6. The illuminated emergency sign as claimed in claim 1, characterized in that the acrylic sign panel is provided with a safety exit sign and a direction sign on a surface thereof.

* * * * *